US011361742B2

(12) United States Patent
Herman et al.

(10) Patent No.: US 11,361,742 B2
(45) Date of Patent: Jun. 14, 2022

(54) MODAL REVERB EFFECTS FOR AN ACOUSTIC SPACE

(71) Applicant: Eventide Inc., Little Ferry, NJ (US)

(72) Inventors: Woodrow Q. Herman, New York, NY (US); Russell Wedelich, Bronx, NY (US); Anthony M. Agnello, Princeton, NJ (US)

(73) Assignee: Eventide Inc., Little Ferry, NJ (US)

( * ) Notice: Subject to any disclaimer, the term of this patent is extended or adjusted under 35 U.S.C. 154(b) by 0 days.

(21) Appl. No.: 16/585,036

(22) Filed: Sep. 27, 2019

(65) Prior Publication Data

US 2021/0097964 A1 Apr. 1, 2021

(51) Int. Cl.

| | |
|---|---|
| ***G10H 1/00*** | (2006.01) |
| ***G10G 7/02*** | (2006.01) |
| ***G10H 7/02*** | (2006.01) |
| ***G10H 5/02*** | (2006.01) |

(52) U.S. Cl.

CPC ..... *G10H 1/0091* (2013.01); *G10H 1/0008* (2013.01); *G10G 7/02* (2013.01); *G10H 5/02* (2013.01); *G10H 7/02* (2013.01); *G10H 2210/281* (2013.01)

(58) Field of Classification Search

CPC ..... G10H 1/0091; G10H 1/0008; G10H 2210/281; G10H 5/02; G10H 7/02

See application file for complete search history.

(56) References Cited

U.S. PATENT DOCUMENTS

| | | | | |
|---|---|---|---|---|
| 5,565,641 | A * | 10/1996 | Gruenbaum | G10H 1/0066 84/451 |
| 7,003,120 | B1 * | 2/2006 | Smith | G10H 1/20 381/103 |
| 9,805,704 | B1 * | 10/2017 | Abel | G10H 1/0091 |
| 10,019,980 | B1 * | 7/2018 | Abel | G10H 1/125 |
| 2004/0136549 | A1 * | 7/2004 | Pennock | G10H 1/02 381/119 |

(Continued)

FOREIGN PATENT DOCUMENTS

| | | |
|---|---|---|
| EP | 1516511 A1 | 3/2005 |
| EP | 2639787 A1 | 9/2013 |

(Continued)

OTHER PUBLICATIONS

Canfield-dafilou et al, resizing Rooms in Convolution Delay Network and modal reverberator (Year: 2018).*

(Continued)

*Primary Examiner* — Matthew A Eason
*Assistant Examiner* — Kuassi A Ganmavo
(74) *Attorney, Agent, or Firm* — Lerner, David, Littenberg, Krumholz & Mentlik, LLP

(57) ABSTRACT

Methods and systems for performing modified reverb techniques for audio signals are described. The method may involve receiving an audio signal, a modal reverb effect to be applied to the audio signal, and an indication of a plurality of frequencies. Modes of vibration of a space simulated by the reverb effect may be separated into a set of frequencies included in the input, and a set frequencies not included in the input. The modal reverb effect may be modified by separately adjusting the separate sets of modes of vibration. The modified effect may then be applied to the audio signal.

26 Claims, 2 Drawing Sheets

200

(56) References Cited

U.S. PATENT DOCUMENTS

| | | | | |
|---|---|---|---|---|
| 2006/0075883 | A1* | 4/2006 | Thorne | G10H 3/125 84/616 |
| 2008/0072739 | A1* | 3/2008 | Ueno | G10G 7/02 84/454 |
| 2012/0297959 | A1* | 11/2012 | Serletic | G09B 15/04 84/626 |
| 2014/0060289 | A1* | 3/2014 | Hirshberg | G10H 3/188 84/654 |

FOREIGN PATENT DOCUMENTS

| | | | |
|---|---|---|---|
| EP | 2902999 | A1 | 8/2015 |
| WO | 03096743 | A2 | 11/2003 |

OTHER PUBLICATIONS

Shroeder, Colorless Artificial reverberation (Year: 1961).*
International Search Report with Written Opinion for Application No. PCT/US2020/052386 dated Nov. 27, 2020, 14 pages.

* cited by examiner

200

MODAL REVERB EFFECTS FOR AN ACOUSTIC SPACE

BACKGROUND

Audio engineers, musicians, and even the general population (collectively "users") are accustomed to generating and manipulating audio signals. For instance, audio engineers edit stereo signals by mixing together monophonic audio signals using effects such as pan and gain to position them within the stereo field. Users also manipulate audio signals into individual components for effects processing using multiband structures, such as crossover networks, for multiband processing. Additionally, musicians and audio engineers regularly use audio effects, such as compression, distortion, delay, reverberation, etc., to create sonically pleasing, and in some cases unpleasant sounds. Audio signal manipulation is typically performed using specialized software or hardware. The type of hardware and software used to manipulate the audio signal is generally dependent upon the user's intentions. Users are constantly looking for new ways to create and manipulate audio signals.

Reverb is one of the most common effects users apply to an audio signal. The reverb effect simulates the reverberation of a specific room or acoustic space, thus causing an audio signal to sound as if it were recorded in a room having a specific impulse response.

One way of applying reverb to an audio signal is to use a technique called convolution. Convolutional reverb applies the impulse response of a given acoustic space to an audio signal, resulting in the audio signal sounding as if it were produced in the given space. However, the techniques for manipulating the parameters of a convolutional reverb are relatively limited. For instance, using convolutional reverb, it may not be possible to isolate and manipulate the resonance of a single frequency within the audio signal. Additionally, using convolutional reverb, it also may not be possible to adjust or manipulate a single property of a simulated physical space (e.g., the space's length, the space's width).

An alternative way of applying reverb to an audio signal is to use a technique called modal reverb. Unlike convolutional reverb, modal reverb analyzes the impulse response of a given space, identifies the modes of vibration in the given space based on the analysis, and then synthesizes the individual modes of vibration of the space. As a result, individual frequencies of the reverb can be isolated and edited, and the techniques for manipulating the parameters of a modal reverb are more robust than those for manipulating the parameters of a convolutional reverb technique.

One challenge in audio production arises in audio signals in which many instruments are playing simultaneously with reverberation. The reverberation may be a property of the setting at which the audio signal was recorded, or may have been added by audio engineering. In either case, and particularly when multiple sources in the audio signal have reverb, it may become difficult to balance these various sources with one another.

Currently available products for audio signal manipulation and equalization allow users to equalize either the input signal or the output signal. In some cases an impulse response applied to the audio signal may be equalized. However, in all such cases, overlap between multiple sources hinders the ability of the known equalizers to balance the sources.

SUMMARY

The technology relates to systems that control the characteristics of a reverb effect applied to an audio signal. It also relates to software applications that manage such systems to improve the resulting signal, and to optionally interface with users in order to give the users more control over the reverb effect and the resulting signal. This may improve upon the known reverb techniques by separately controlling the particular frequencies at which the source or sources of the audio signal are known to reverberate. In some cases, energy of the audio signal at those particular frequencies may be selectively reduced when a reverb effect is applied, so that the applied reverb enhances the signal instead of clashing with the audio sources. In other cases, energy at the particular frequencies may be selectively boosted when a reverb effect is applied to give the impression of a well-tempered source. Other example effects are described herein.

The technology may be implemented on a computer or network of computers in the form of software or machine instructions on a server or an electronic device that communicates with an application on an electronic device. The computer or network of computers may include one or more processors and memory storing one or more programs configured to be executed by the one or more processors. The memory may further store data used in executing the one or more programs. In operation, the one or more programs may receive an audio signal and an input from a user, and may adjust properties of the reverb effect applied to the audio signal based on the user input.

In the case of a modal reverb effect being applied to the audio signal, the modal reverb effect may be generated by computing the individual modes of vibration of an acoustic space from an analysis of an impulse response of the acoustic space. Each mode of vibration may include a modal frequency and a modal shape. The one or more programs may then adjust the modal shape of the particular modes of vibration that correspond to a frequency indicated by the user input. Adjusting the modal shape may involve reducing or increasing the energy of the particular mode of vibration in the modal reverb effect, depending on the effect desired by the user. The modified modal reverb effect may then be applied to the audio signal.

A similar concept may be applied to modify a convolution reverb effect applied to the audio signal. In the case of the convolution reverb effect, the impulse response of the acoustic space may be transformed using a Fast Fourier Transform (FFT) in order to represent the acoustic space in the frequency domain. Portions of the frequency-domain signal corresponding to the one or more frequencies of the user input may then be adjusted.

The user input may include one or more frequencies. Those frequencies may correspond to the frequencies of a collection of notes played in the recording. The collection of notes may be a key of the recording, a scale, or one or more instruments played in the recording. In some cases, the one or more frequencies may include harmonics (e.g., second order harmonics, etc.) of the notes as well as inharmonic frequencies of the notes.

In operation, the system may be used to achieve a reverb effect of an audio signal without adding energy that clashes with certain instruments in the audio signal. For example, if a user wishes to apply a reverb effect to an audio recording in which a piano (among other instruments and/or sounds) is playing, the user may provide the audio recording to the system, select a desired reverb effect, and further select "piano" as a user input. The program may then modify the selected reverb effect based on the particular frequencies associated with the "piano" input (e.g., notes of the piano, harmonics, etc.). The selected reverb effect may be damped at or around the particular frequencies of the user input in order not to interfere with the sound of other instruments in the recording. This will achieve the reverb effect applied to the recording, but in a way that envelops and enhances the sound of the piano without clashing with other instruments.

In another example, instead of selecting a particular instrument, the user may select a key, such as C-major. In this case, the energy of the selected reverb effect may be damped at or around the frequencies associated with the C-major key, while the energy of the reverb effect at the remaining frequencies may be maintained.

In other examples, instead of damping the energy of the selected reverb effect at particular frequencies, the energy may be boosted at the particular frequencies in order to create the effect of a well-tempered instrument or acoustic space One aspect of the disclosure provides a method performed by one or more processors, including: receiving an audio signal, receiving a modal reverb effect to be applied to the audio signal, the modal reverb effect including one or more modes of vibration of a given acoustic space, each mode of vibration having a corresponding modal frequency, determining a plurality of frequencies for modifying the modal reverb effect, generating from the one or more modes of vibration of the modal reverb effect, first and second sets of modes of vibrations, each mode of vibration included in the first set having a modal frequency that corresponds to one of the plurality of frequencies, and each mode of vibration included in the second set having a modal frequency that does not correspond to any of the plurality of frequencies, modifying the modal reverb effect by adjusting the first set of modes of vibration of the modal reverb effect separate from the second set of modes of vibration of the modal reverb effect, and applying the modified modal reverb effect to the audio signal.

In some examples, the plurality of frequencies may correspond to the frequencies of the notes of the chromatic scale within a specified range. In some examples, the plurality of frequencies may include two or more frequencies corresponding to notes of a microtonal scale. In some examples, the plurality of frequencies may correspond to a subset of the frequencies of the notes of the chromatic scale. Determining a plurality of frequencies for modifying the modal reverb effect may involve receiving, by the one or more processors, an input indicating a musical key or a musical scale, each of the plurality of frequencies corresponding to a frequency of a note included in the musical key or musical scale. Additionally or alternatively, determining a plurality of frequencies for modifying the modal reverb effect may involve receiving, by the one or more processors, an input indicating one or more instruments, the plurality of frequencies being associated with the one or more instruments. The one or more instruments may include any one or combination of: a piano having a plurality of keys, each key corresponding to a frequency, the plurality of frequencies including the corresponding frequencies of the keys; and a guitar having a plurality of strings, each string having a plurality of frets, each fret of each string corresponding to a frequency, the plurality of frequencies including the corresponding frequencies of the frets.

In some examples, the plurality of frequencies may include one or more fundamental frequencies, and harmonics of the fundamental frequencies. In some examples, adjusting the first set of modes may involve adjusting the modal shape of each mode included in the first set of modes, such as reducing, by the one or more processors, an energy of each mode included in the first set of modes, or increasing, by the one or more processors, an energy of each mode included the first set of modes.

In some examples, determining a plurality of frequencies for modifying the modal reverb effect may involve deriving, by the one or more processors, the plurality of frequencies from an analysis of the audio signal.

Another aspect of the disclosure provides for a system including one or more processing devices, and memory storing one or more programs configured to be executed by the one or more processing devices. The one or more programs may include instructions for performing, by the one or more processing devices: receiving an audio signal; receiving a modal reverb effect to be applied to the audio signal, the modal reverb effect including one or more modes of vibration of a given acoustic space, each mode of vibration having a corresponding modal frequency; determining a plurality of frequencies for modifying the modal reverb effect; generating from the one or more modes of vibration of the modal reverb effect, first and second sets of modes of vibrations, each mode of vibration included in the first set having a modal frequency that corresponds to one of the plurality of frequencies, and each mode of vibration included in the second set having a modal frequency that does not correspond to any of the plurality of frequencies; modifying the modal reverb effect by adjusting the first set of modes of vibration of the modal reverb effect separate from the second set of modes of vibration of the modal reverb effect; and applying the modified modal reverb effect to the audio signal.

In some examples, the plurality of frequencies may correspond to the frequencies of the notes of the chromatic scale within a specified range. In some examples, the plurality of frequencies may include two or more frequencies corresponding to notes of a microtonal scale. The plurality of frequencies may correspond to a subset of the frequencies of the notes of the chromatic scale. The one or more processing devices may be configured to receive an input indicating a musical key or a musical scale, each of the plurality of frequencies corresponding to a frequency of a note included in the musical key or musical scale. Additionally or alternatively, the one or more processing devices may be configured to receive an input indicating one or more instruments, wherein the plurality of frequencies are associated with the one or more instruments. The one or more instruments may include any one or combination of: a piano having a plurality of keys, each key corresponding to a frequency, the plurality of frequencies including the corresponding frequencies of the keys; and a guitar having a plurality of strings, each string having a plurality of frets, each fret of each string corresponding to a frequency, the plurality of frequencies including the corresponding frequencies of the frets.

In some examples, the plurality of frequencies may include one or more fundamental frequencies, and harmonics of the fundamental frequencies.

In some examples, the one or more processing devices may be configured to adjust the modal shape of each mode included in the first set of modes, such as by adjusting the modal shape to reduce an energy of each mode included in the first set of modes, or by adjusting the modal shape to increase an energy of each mode included in the first set of modes.

In some examples, the one or more processing devices may be configured to analyze the audio signal and determine at least one of a key, a scale or an instrument of the audio signal based on the analysis. The determined plurality of frequencies for modifying the modal reverb effect may correspond to frequencies of the determined key, scale or instrument.

BRIEF DESCRIPTION OF THE DRAWINGS

The foregoing aspects, features and advantages of the present invention will be further appreciated when considered with reference to the following description of exemplary embodiments and accompanying drawings, wherein like reference numerals represent like elements. In describing the embodiments of the invention illustrated in the drawings, specific terminology may be used for the sake of clarity. However, the aspects of the invention are not intended to be limited to the specific terms used.

DETAILED DESCRIPTION

Figure 1:
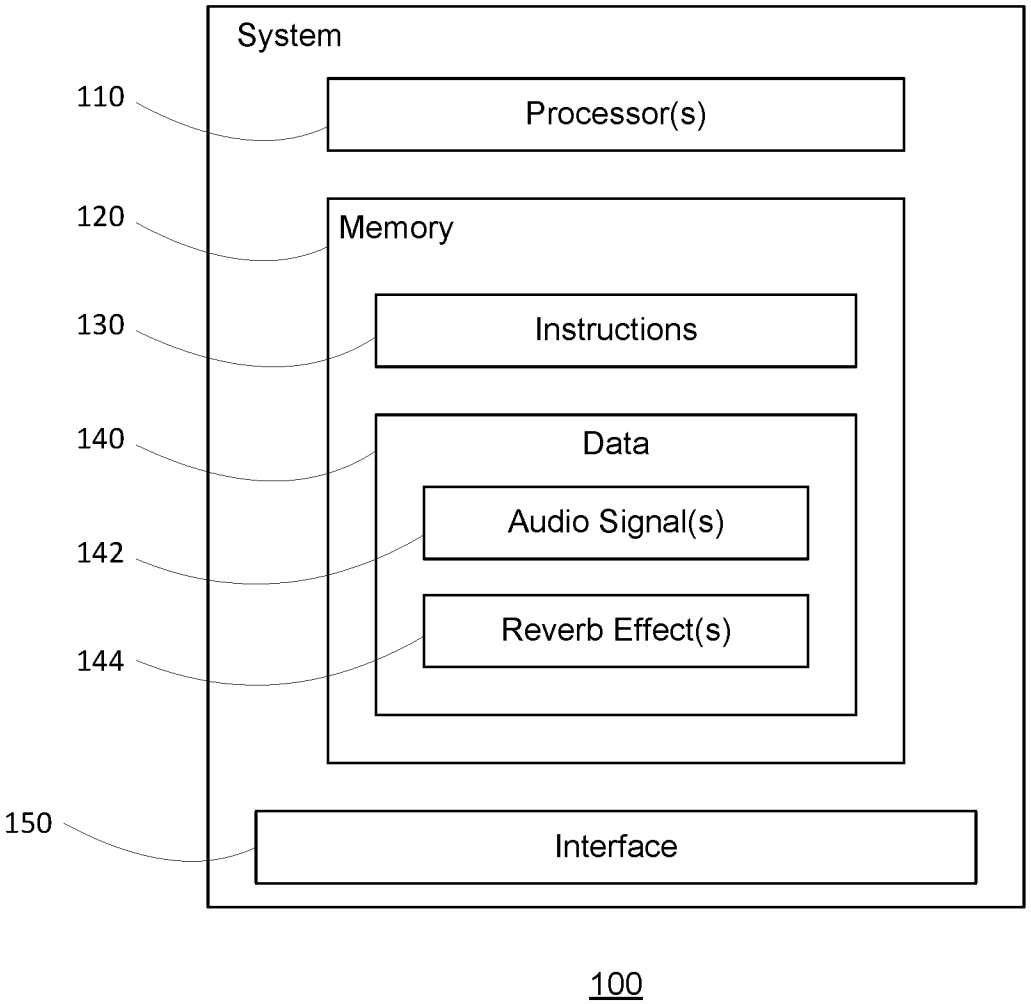
FIG. 1 is a block diagram of an example system according to an aspect of the present disclosure.

FIG. 1 illustrates an example system 100 for performing the modal reverb techniques described in the present application. The system 100 may include one or more processing devices 110 configured to execute a set of instructions or executable program. The processors may be dedicated components such as general purpose CPUs, or application specific integrated circuit ("ASIC"), or may be other hardware-based processors. Although not necessary, specialized hardware components may be included to perform specific computing processes faster or more efficiently. For example, operations of the present disclosure may be carried out in parallel on a computer architecture having multiple cores with parallel processing capabilities.

Instructions are described in greater detail in connection with the flow diagram of FIG. 2. The system may further include one or more storage devices or memory 120 for storing the instructions 130 and programs executed by the one or more processors 110. Additionally, the memory 120 may be configured to store data 140, such as one or more audio signals 142, and one or more reverb effects 144 that may be applied to the audio signals. For example, a reverb effect 144 may be chosen to make an audio signal sound as if it were recorded in a different acoustic space. Some reverb effects may apply convolution, while other reverb effects may operate by identifying and synthesizing the various modes of vibration a selected impulse response (IR).

The system 100 may further include an interface 150 for input and output of data. For example, audio signals and selected reverb effects may be input to the system via the interface 150. Additionally, and as described in greater detail below, modifications to the selected reverb effect may also be input to the system via the interface 150. The system may also output an audio signal to which a modified or unmodified reverb effect has been applied via the interface 150. Other parameters and instructions may be provided to and from the system via the interface 150.

In some examples, the system 100 may include a personal computer, laptop, tablet, or other computing device of the user, housing therein both processors and memory. Operations performed by the system are described in greater detail in connection with the routines of FIG. 2.

Figure 2:
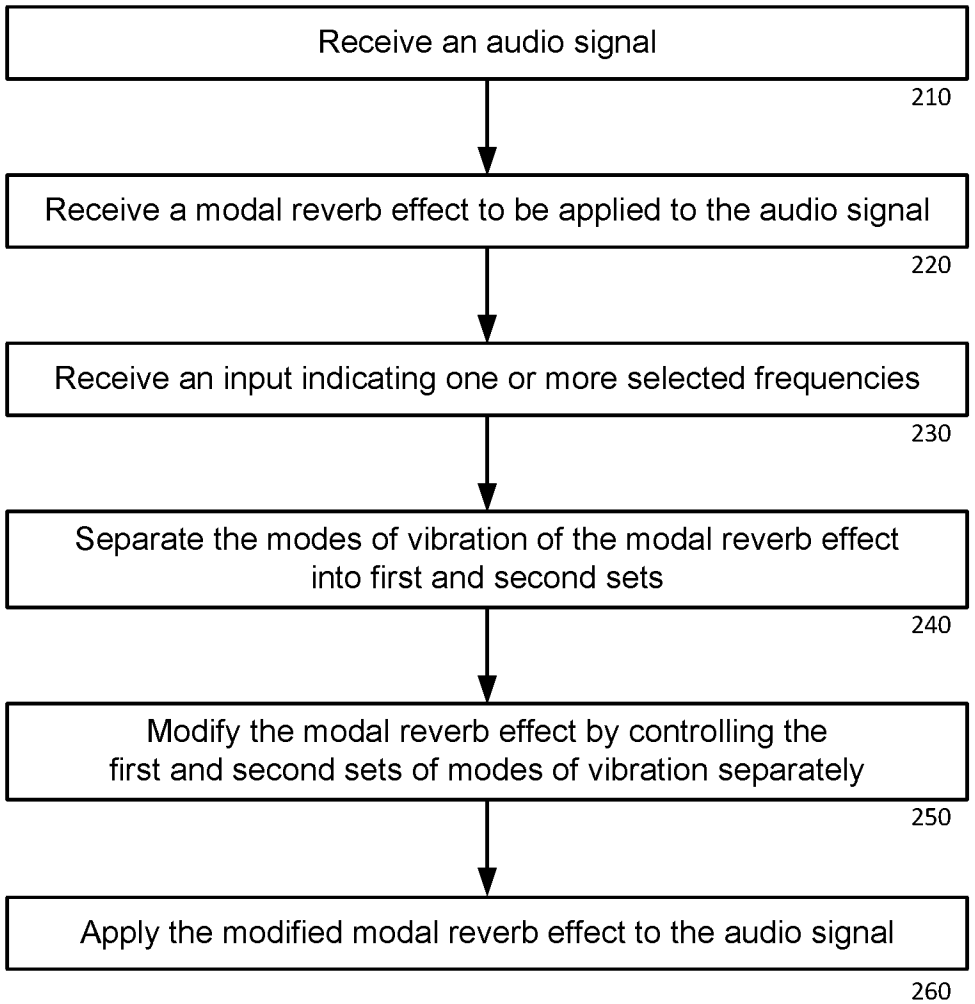
FIG. 2 is a flow diagram of an example method according to an aspect of the present disclosure.

FIG. 2 is a flow diagram illustrating an example routine 200.

At block 210, the system may receive an audio signal. The audio signal may be a recorded audio file having one or more audio sources, such as musical instruments.

At block 220, the system may receive a selected modal reverb effect to be applied to the audio signal. In some examples, the modal reverb effect may include one or more modes of vibration of a given acoustic space, whereby applying the modal reverb to the audio signal may cause the audio signal to sound as if it were recorded in the given acoustic space. Each mode of vibration may be characterized such its respective properties, such as its shape and frequency. The frequency of the mode of vibration may be a frequency at which the mode is centered or a greatest amount of energy for the mode is concentrated. The shape of the mode for each given frequency may dictate how the selected modal reverb effect affects the portion of the audio signal located at the corresponding given frequency.

At block 230, the system may receive an input indicating one or more selected frequencies. The selected frequencies may correspond to frequencies of certain modes for which it may be desired to separately control application of the reverb effect to the audio signal. For example, in the case of an audio signal containing music from one or more instruments, the selected frequencies may be selected based on a key or a scale of the music, the notes that can be played on the one or more instruments, other factors, or any combination thereof.

At block 240, the system may separate the particular modes of vibration of the selected modal reverb effect into first and second sets. The first set may include those modes of vibration that correspond to modal frequencies included in the selected plurality of frequencies. The second set may include those modes of vibration that correspond to modal frequencies not included in the plurality of selected frequencies.

At block 250, the system may modify the selected modal reverb effect by controlling the first and second sets of modes of vibration separately. For instance, an energy of the first set of modes of vibration may be modified (e.g., increased, reduced) separately from an energy of the second set of modes of vibration. The result may be a modified modal reverb effect that, when applied to the audio signal, may result in reverb without clashing reverb effects between the different sources included in the audio signal. At block 260, the system may apply the modified modal reverb effect to the audio signal.

In one example embodiment of the routine 200 of FIG. 2, the audio signal may be a recording of several instruments, and the plurality of selected frequencies may be a preselection, thus not requiring manual input. The preselected frequencies may correspond to the frequencies of the notes included in the chromatic scale within a specified range (e.g., audible frequencies). In the recording, one may expect the instruments to play primarily notes of the chromatic scale, such that the majority of the energy in the audio signal from those instrument sources in the recording would be concentrated around the frequencies of the chromatic scale notes. Hence, one may also expect adding energy of a modal reverb effect at those frequencies to cause overlap that interferes with an engineer's ability to equalize or balance the instruments in the audio signal. By separating out those frequencies, the modal reverb effect can be emphasized at other frequencies, thus avoiding the unwanted overlap.

In another example, instead of selecting all frequencies that correspond to notes of the chromatic scale, a subset of frequencies may be selected or preselected. This may be preferable if the audio recording is in a known key or scale, or if the audio recording is known to include certain instruments capable of playing a relatively limited number of notes.

For instance, if the audio recording is known to be played in C major, then it may be reasonably expected that reducing energy of the modal reverb effect at only the frequencies corresponding to the notes of the C major key would be sufficient to avoid the unwanted overlap. Since concepts may be applied for other keys or scales, such as the pentatonic scale.

For further instance, if the audio recording is known to include a specific instrument, then plurality of selected frequencies may correspond to the central frequencies of the notes generated by that instrument. For the sake of example, if the audio recording includes a piano, then those notes may be the notes played by the keys of the piano.

In some examples, the selection of notes of an instruments and notes of a musical key or scale may be combined with one another. Taking the example of the piano again (although the example could apply the same to any other instrument), the piano and other instruments in the audio recording may be playing a tune in a particular key or musical scale. Thus, the plurality of selected frequencies may correspond to the central frequencies of the specific notes included in the key or scale, as well as the notes of the piano. In this manner, both the key and notes of the piano may be taken into account. For instance, the selected frequencies may correspond to frequencies that are both notes of the piano and notes of the key or scale.

In any of the above examples, energy at the selected frequencies may be reduced in order to avoid the reverb at the selected notes from clashing between instruments in the recording. However, due to the timbre of each instrument, the frequencies emitted by the instruments are not limited to the selected notes, and so the reverb would not be eliminated since there were still be energy at other frequencies surrounding the selected notes. As a result, the remaining energy may envelop or sweeten the notes of each instrument without interfering with balancing for the other instruments of the audio recording.

For the sake of example, one would expect a similar effect may be produced for a guitar. In the case of the guitar, each string of the guitar may be used to play multiple notes as dictated by the frets on the guitar's fret board. The plurality of selected frequencies may then correspond to the central frequencies of all of the notes that can be generated by the strings and frets. As with the piano or any other instrument, the plurality of selected frequencies may further be limited to central frequencies of the notes included in a particular key or scale of a given recording. Energy at the selected frequencies may then be reduced in order to avoid the reverb of the guitar clashing with the other instruments in the recording. Due to the timbre of the guitar, the frequencies emitted by the guitar are not limited to the selected notes, so the reverb would not be eliminated since there were still be energy at the frequencies surrounding the selected notes. As a result, the remaining energy may envelop or sweeten the notes of the guitar without interfering with balancing for the other instruments.

However, the guitar presents an additional facet for manipulating reverb effects using the routine of the present disclosure. A user may adjust the frequency of a note on the guitar by bending the guitar string while playing. This will cause more energy to be concentrated around frequencies surrounding a selected frequency, which in turn will cause the reverb effect to suddenly bloom. Because the reverb is not at a selected frequency, one may expect that it will not interfere with balancing for the other instruments in the recording.

The above examples describe decreasing energy around a given frequency in order to avoid clashing between instruments. However, in other examples, the energy at a selected frequency may be increased. This may give the impression of the source of the note at the selected frequency being well tempered, while the reverb effects of the surrounding environment may be subdued.

The above examples generally describe selecting a single set of frequencies and then reducing or increasing the energy at those frequencies separately from other modes of vibration included in the selected modal reverb effect. The same concept may be used to divide selected frequencies into individual sets and to control those sets separately. In this regard, the notes of a first instrument (e.g., piano) may be designated to a first set, and the notes of a second instrument (e.g., guitar) may be designated to a second set. In a similar regard, the audio recording may change keys, whereby the frequencies of the notes of a first key may correspond to a first set of selected frequencies, and the frequencies of the notes of a subsequently played second key may correspond to a second set of selected frequencies. The reverb effect may then be adjusted for different portions of the audio recording depending on the instrument, the key or any combination thereof, playing at each portion of the recording.

In some examples, the selected frequencies may include not only the frequencies corresponding to dominant frequencies of the notes of the instruments or audio recording, but also harmonics or inharmonics of those dominant frequencies. In the case of a selected frequency corresponding to a dominant frequency of a note, the harmonic may correspond to an octave above and an octave below the note. The same or similar principles may be applied to other frequencies, and may further be applied to any number of harmonics (second harmonics, third harmonics, etc.) or inharmonics of the given dominant frequency.

In some examples, the selected frequencies may include frequencies that do not correspond to notes of the chromatic scale. In one such example, the audio recording may be played in a microtonal scale, whereby the selected frequencies may be the frequencies corresponding to the notes of the microtonal scale.

The routine of FIG. 2 may be applied manually, automatically, or a combination thereof. In the case of a manual modification, a user may input a desired reverb setting and a set of selected frequencies (which may correspond to a key, a scale, an instrument, or some combination thereof), and the reverb signal may be modified based on the input information. In the case of an automatic modification, the one or more processors may analyze the audio recording or another audio recording in order to determine the particular notes of the sources. Such analysis may involve identifying a key or scale of the recording. In some cases, the analysis may involve determining a type of instrument that is being played in the recording. Furthermore, if the instrument, key or scale of the recording changes during the recording, then the analysis may identify a time that the change occurs, may separate the audio recording into separate portions based on the main frequencies in each portion, and may apply different modifications to the reverb effect for each of the separate portions. The system may further be capable of receiving manual modifications to the automated determinations in order to provide a combination of both manual and automatic input.

For instance, if an audio recording includes each of a first instrument (e.g., a piano) and a second instrument (e.g., a guitar), the recording may be analyzed to identify the frequencies of the notes of the first instrument, and to de-emphasize reverb effects for those frequencies. This in turn may have the effect of emphasizing the reverb effect for the frequencies of the notes of the second instrument that are different from those of the first instrument. In a similar vein, those skilled in the art will recognize that multiple audio recordings may be combined to produce a combined audio recording. Therefore, controlling reverb effects of one recording based on a frequency of another recording may be useful, for instance if it is expected or desired to combine the two recordings with one another.

The above examples generally describe applying the routine of FIG. 2 to a modal reverb effect. Using a modal reverb is particularly beneficial since the modal reverb is made up of several modes of vibration of a simulated or real acoustic space, and the selected frequencies can correspond to frequencies of a select group of the modes of vibration. However, similar principles may be used to modify a convolutional reverb. For example, a Fast Fourier Transform (FFT) may be applied to the impulse response of the simulated space in order to represent the impulse response of the space in the frequency domain. Energy at specific frequencies of the frequency domain representation of the impulse response could then be increased or decreased in the same or a similar manner as described above in order to derive a modified impulse response. The modified impulse response may then be applied to the audio recording using convolutional reverb, thus resulting in a modified reverb effect.

Altogether, the present disclosure may enable a user to more effectively manipulate reverberation effects of an audio recording including multiple sources without impeding the user's ability to balance the sources. The user may start with an audio recording of several instruments, may manually or automatically identify the notes being played in the recording, and may separate the modes of vibration for those notes from the other modes of vibration in a selected modal reverb effect. The modal reverb may then be accentuated or muted, depending on the user's preferences, at the specific identified notes, resulting in a different sound to the audio recording.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method performed by one or more processors, comprising:

receiving an audio signal;

receiving a modal reverb effect to be applied to the audio signal, the modal reverb effect including one or more modes of vibration of a given acoustic space, each mode of vibration having a corresponding modal frequency;

determining a plurality of frequencies for modifying the modal reverb effect;

generating from the one or more modes of vibration of the modal reverb effect, first and second sets of modes of vibrations, wherein each mode of vibration included in the first set has a modal frequency that corresponds to one of the plurality of frequencies, and wherein each mode of vibration included in the second set has a modal frequency that does not correspond to any of the plurality of frequencies;

modifying the modal reverb effect by adjusting the first set of modes of vibration of the modal reverb effect according to a common first reverb setting, wherein the first reverb setting is a change in the modal shape of each mode included in the first set of modes and either (i) not adjusting the second set of modes of vibration of the modal reverb effect or (ii) adjusting the second set of modes of vibration according to a common second reverb setting different from the first reverb setting of the modal reverb effect; and applying the modified modal reverb effect to the audio signal.

2. The method of claim 1, wherein the plurality of frequencies correspond to the frequencies of the notes of the chromatic scale within a specified range.

3. The method of claim 1, wherein the plurality of frequencies includes two or more frequencies corresponding to notes of a microtonal scale.

4. The method of claim 1, wherein the plurality of frequencies correspond to a subset of the frequencies of the notes of the chromatic scale.

5. The method of claim 4, wherein determining a plurality of frequencies for modifying the modal reverb effect comprises receiving, by the one or more processors, an input indicating a musical key or a musical scale, and wherein each of the plurality of frequencies corresponds to a frequency of a note included in the musical key or musical scale.

6. The method of claim 4, wherein determining a plurality of frequencies for modifying the modal reverb effect comprises receiving, by the one or more processors, an input indicating one or more instruments, wherein the plurality of frequencies are associated with the one or more instruments.

7. The method of claim 6, wherein the one or more instruments includes a piano having a plurality of keys, each key corresponding to a frequency, and wherein the plurality of frequencies include the corresponding frequencies of the keys.

8. The method of claim 6, wherein the one or more instruments includes a guitar having a plurality of strings, each string having a plurality of frets, each fret of each string corresponding to a frequency, and wherein the plurality of frequencies include the corresponding frequencies of the frets.

9. The method of claim 1, wherein the plurality of frequencies includes one or more fundamental frequencies, and harmonics of the fundamental frequencies.

10. The method of claim 1, wherein the first reverb setting reduces an energy of each mode included in the first set of modes.

11. The method of claim 1, wherein the first reverb setting increases an energy of each mode included the first set of modes.

12. The method of claim 1, wherein determining a plurality of frequencies for modifying the modal reverb effect comprises deriving, by the one or more processors, the plurality of frequencies from an analysis of the audio signal.

13. A system comprising:

one or more processing devices; and memory storing one or more programs configured to be executed by the one or more processing devices, the one or more programs including instructions for performing, by the one or more processing devices:

receiving an audio signal;

receiving a modal reverb effect to be applied to the audio signal, the modal reverb effect including one or more modes of vibration of a given acoustic space, each mode of vibration having a corresponding modal frequency;

determining a plurality of frequencies for modifying the modal reverb effect;

generating from the one or more modes of vibration of the modal reverb effect, first and second sets of modes of vibrations, wherein each mode of vibration included in the first set has a modal frequency that corresponds to one of the plurality of frequencies, and wherein each mode of vibration included in the second set has a modal frequency that does not correspond to any of the plurality of frequencies;

modifying the modal reverb effect by adjusting the first set of modes of vibration of the modal reverb effect according to a common first reverb setting, wherein the first reverb setting is a change in the modal shape of each mode included in the first set of modes and either (i) not adjusting the second set of modes of vibration of the modal reverb effect or (ii) adjusting the second set of modes of vibration according to a common second reverb setting different from the first reverb setting of the modal reverb effect; and applying the modified modal reverb effect to the audio signal.

14. The system of claim 13, wherein the plurality of frequencies correspond to the frequencies of the notes of the chromatic scale within a specified range.

15. The system of claim 13, wherein the plurality of frequencies includes two or more frequencies corresponding to notes of a microtonal scale.

16. The system of claim 13, wherein the plurality of frequencies correspond to a subset of the frequencies of the notes of the chromatic scale.

17. The system of claim 16, wherein the one or more processing devices are configured to receive an input indicating a musical key or a musical scale, wherein each of the plurality of frequencies corresponds to a frequency of a note included in the musical key or musical scale.

18. The system of claim 16, wherein the one or more processing devices are configured to receive an input indicating one or more instruments, wherein the plurality of frequencies are associated with the one or more instruments.

19. The system of claim 18, wherein the one or more instruments includes a piano having a plurality of keys, each key corresponding to a frequency, and wherein the plurality of frequencies include the corresponding frequencies of the keys.

20. The system of claim 18, wherein the one or more instruments includes a guitar having a plurality of strings, each string having a plurality of frets, each fret of each string corresponding to a frequency, and wherein the plurality of frequencies include the corresponding frequencies of the frets.

21. The system of claim 13, wherein the plurality of frequencies includes one or more fundamental frequencies, and harmonics of the fundamental frequencies.

22. The system of claim 13, wherein the one or more processing devices are configured to adjust the modal shape of each mode included in only the first set of modes.

23. The system of claim 22, wherein the one or more processing devices are configured to adjust the modes of vibration of the modal reverb effect by adjusting the modal shape to reduce an energy of each mode included in only the first set of modes.

24. The system of claim 22, wherein the one or more processing devices are configured to adjust the modes of vibration of the modal reverb effect by adjusting the modal shape to increase an energy of each mode included in only the first set of modes.

25. The system of claim 13, wherein the one or more processing devices are configured to:

analyze the audio signal; and determine at least one of a key, a scale or an instrument of the audio signal based on the analysis, wherein the determined plurality of frequencies for modifying the modal reverb effect correspond to frequencies of the determined key, scale or instrument.

26. A method performed by one or more processors, comprising:

receiving an audio signal;

receiving a modal reverb effect to be applied to the audio signal, the modal reverb effect including one or more modes of vibration of a given acoustic space, each mode of vibration having a corresponding modal frequency;

determining a plurality of frequencies for modifying the modal reverb effect;

generating from the one or more modes of vibration of the modal reverb effect, first and second sets of modes of vibrations, wherein each mode of vibration included in the first set has a modal frequency that corresponds to one of the plurality of frequencies, and wherein each mode of vibration included in the second set has a modal frequency that does not correspond to any of the plurality of frequencies;

modifying the modal reverb effect by adjusting the first set of modes of vibration of the modal reverb effect separate from the second set of modes of vibration of the modal reverb effect; and applying the modified modal reverb effect to the audio signal, wherein the plurality of frequencies correspond to one of:

the frequencies of the notes of the chromatic scale within a specified range; or a subset of the frequencies of the notes of the chromatic scale.

* * * * *